US007204791B1

(12) United States Patent
Baumler et al.

(10) Patent No.: US 7,204,791 B1
(45) Date of Patent: Apr. 17, 2007

(54) ONE HANDED DOCK AND LOCK EXERCISE STATION

(75) Inventors: Thomas K. Baumler, Forest Lake, MN (US); Nathan R. Luger, Roseville, MN (US)

(73) Assignee: Brunswick Corporation, Lake Forest, IL (US)

( * ) Notice: Subject to any disclaimer, the term of this patent is extended or adjusted under 35 U.S.C. 154(b) by 639 days.

(21) Appl. No.: 10/386,177

(22) Filed: Mar. 7, 2003

(51) Int. Cl.
*A63B 26/00* (2006.01)

(52) U.S. Cl. ..... 482/142; 482/148; 482/136

(58) Field of Classification Search ..... 482/136, 482/148, 142, 92; D21/676, 686, 690; 482/72
See application file for complete search history.

(56) References Cited

U.S. PATENT DOCUMENTS

2004/0176227 A1* 9/2004 Endelman ..... 482/142
2004/0214697 A1* 10/2004 Gerschefske et al. ..... 482/142

* cited by examiner

*Primary Examiner*—Lori Amerson
(74) *Attorney, Agent, or Firm*—Andrus, Sceales, Starke & Sawall, LLP

(57) ABSTRACT

An exercise station for an exercise device such as a shoulder press or other device includes a dock extending from the exercise device, and a user support such as a shoulder press bench or other support engaging the dock in docking relation and releasably locked thereto. The user support is removable and replaceable in a one handed operation.

11 Claims, 2 Drawing Sheets

ONE HANDED DOCK AND LOCK EXERCISE STATION

BACKGROUND AND SUMMARY

The invention relates to exercise stations for an exercise device or gym, and more particularly to a docking system enabling easy change of a user support such as a bench or other exercise station such as a leg press, arm curl, and so on.

It is desired to provide a quick, simple, easy system for securely attaching and removing a bench or other exercise station to an exercise device or gym. In one desirable aspect, the present invention enables one handed operation with minimal lifting, and no use of tools. In one embodiment, a bench with wheels is rolled into a docking station and locked in place in order to perform pressing movements. The bench can be easily unlocked and rolled out of its station in order to perform leg or other exercises where it is necessary to have the bench out of the way. The dock and lock system can also be used to easily secure other user supports such as leg press, arm curl, and so on, expanding the functionality and versatility of an exercise station and gym.

DETAILED DESCRIPTION

Figure 1:
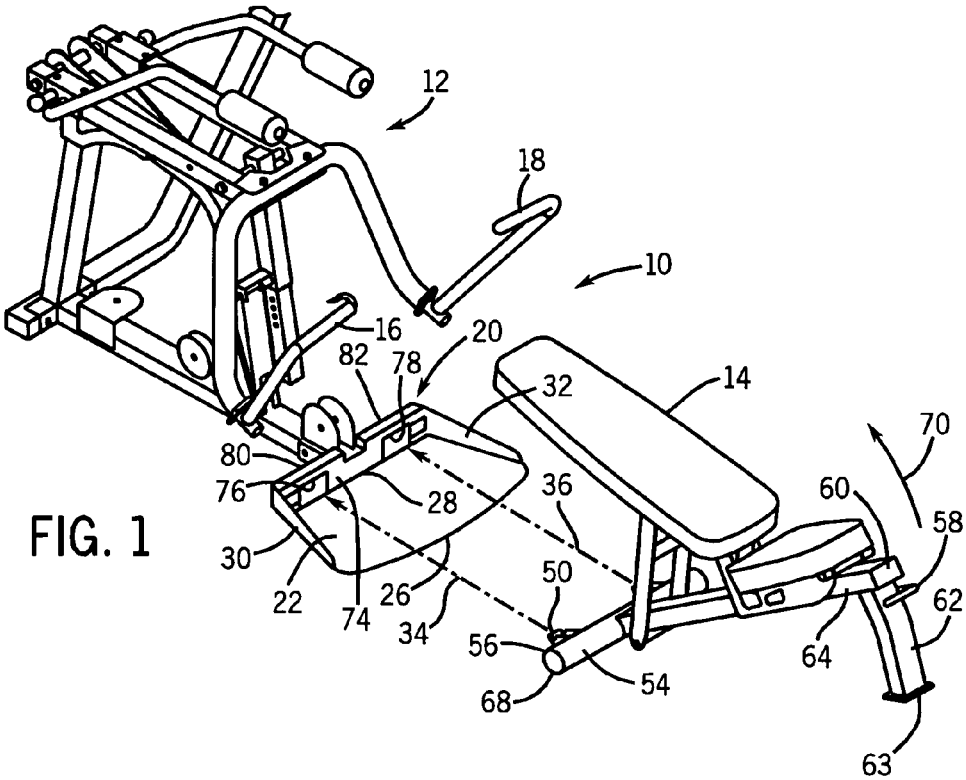
FIG. 1 is a perspective view of an exercise station in accordance with the invention.

FIG. 1 shows an exercise station 10 for an exercise device 12. One example of exercise device 12 is a press exercise device, such as a multi-press, such as a flat chest press, incline bench press, decline bench press, shoulder press, and the like, wherein the user lies on bench 14 and moves press handles 16 and 18 upwardly against resistance, such as provided by a weight stack or the like. One example of a press exercise device is shown in commonly owned copending U.S. patent application Ser. No. 10,384,135 filed on even date herewith, incorporated herein by reference, though other types of presses and other types of exercise devices may be used in conjunction with the present invention.

Figure 2:
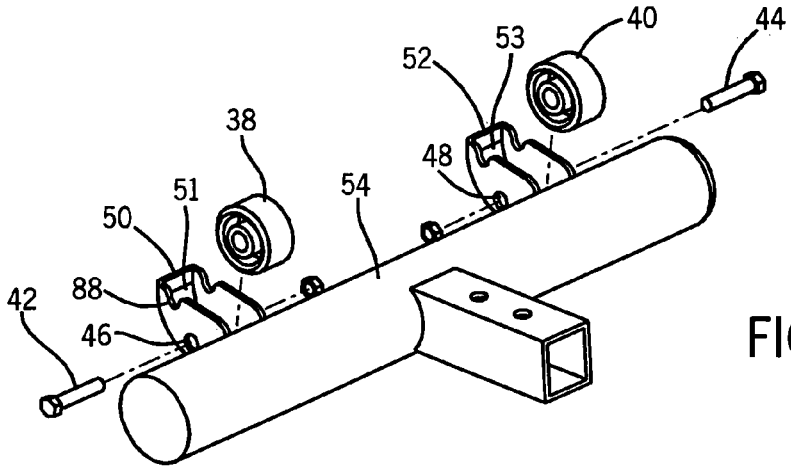
FIG. 2 is an enlarged exploded perspective view of a portion of FIG. 1.

Exercise station 10 includes a dock 20 extending from exercise device 12, and a user support, such as bench 14, engaging the dock in docking relation and releasably locked thereto. Dock 20 includes a foot plate 22 resting on a floor 24, FIG. 3, supporting exercise device 12. The foot plate has a front entrance end 26 and a rear stop end 28. A pair of sidewalls 30 and 32 extend upwardly from the foot plate on distally opposite lateral sides thereof and are tapered towards each other to a smaller lateral gap therebetween at rear stop end 28 than at front entrance end 26 to guide user support 14 inserted rearwardly as shown at arrows 34, 36 along foot plate 22 from front entrance end 26 and guiding the user support to rear stop end 28 in nested relation thereat. A pair of roller wheels 38 and 40, FIG. 2, are mounted on the user support in journaled relation at respective bolts 42 and 44 extending through respective holes 46 and 48 in hook-shaped brackets 50 and 52 mounted to lateral cross-tube 54 of user support bench 14, such that the latter rolls into engagement with dock 20 as shown at arrows 34, 36. Brackets 50, 52 have lower openings 51, 53, respectively, through which wheels 38, 40 extend, respectively. User support 14 is inserted in a rearward direction, arrows 34, 36, into engagement with dock 20. Roller wheels 38, 40 are at the rear end 56 of user support 14. A handle 58 is provided at the front end 60 of the user support. The user lifts front end 60 at handle 58 and rolls user support 14 on wheels 50, 52 rearwardly into engagement with dock 20. Alternatively, the front handle may be simply provided by front end 60 itself being grasped by the user, or by front leg 62 or longitudinal beam 64 or the like.

Figure 4:
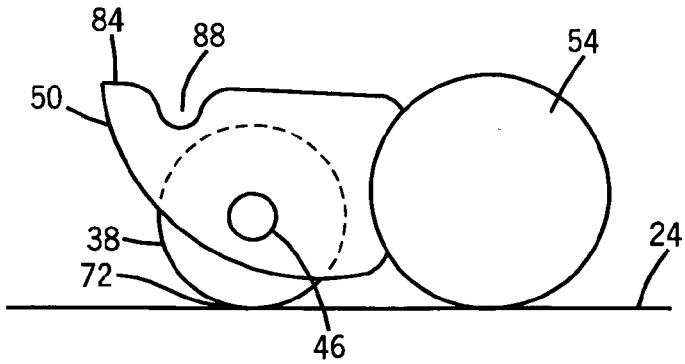
FIG. 4 is a side sectional view of another portion of FIG. 1.

User support 14 has a first position resting on the floor 24 which also supports exercise device 12. In such position, the bottom 66 of front leg 62 and the bottom 68 of crossbar 54 rests on the floor. User support 14 has a second position tilted upwardly at front end 60 as shown at arrow 70 about rear end 56. Wheels 38, 40 are mounted to the user support at rear end 56 such that the wheels engage the floor and are rollable therealong in the noted second upwardly tilted position of user support 14, and such that wheels 38, 40 are spaced above and disengaged from the floor when user support 14 is in the noted first position with front leg 62 resting on the floor. This latter position is illustrated in FIG. 4 where wheel 38 is spaced above floor 24 by vertical gap 72. When the user lifts front end 60 of support 14 upwardly as shown at arrow 70, wheel 38 moves downwardly in FIG. 4 and engages floor 24.

Figure 3:
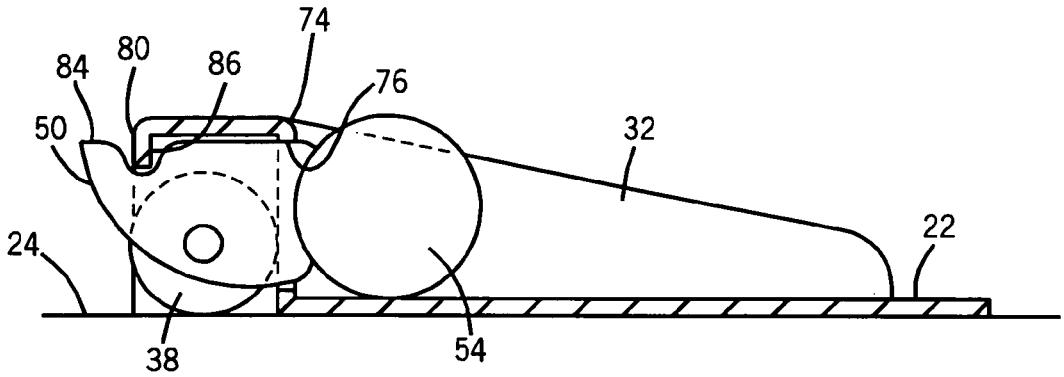
FIG. 3 is a side sectional view of a portion of FIG. 1.

Dock 20 has a rear upstanding wall 74 having a pair of window openings 76 and 78 receiving respective roller wheels 38 and 40 rolling rearwardly therethrough and locating user support 14 in nested relation at dock 20. Roller wheels 38, 40 are mounted in the noted journaled relation on a respective pair of hooks provided by the noted hook-shaped brackets 50, 52 at rear end 56 of user support 14. Dock 20 has a pair of catches 80 and 82 spaced rearwardly of respective window openings 76, 78 and lying out of the path of movement of respective hooks 50, 52 when user support 14 is in the noted second upwardly tilted position, to permit rearward movement of user support 14 rolling on wheels 38, 40 and rearward movement of hooks 50, 52 past catches 80, 82. Catches 80, 82 lie in the path of movement of hooks 50, 52 when user support 14 is in the noted first position, to block forward movement of user support 14 by engagement of hooks 50, 52 against catches 80, 82, and permitting forward movement of user support 14 and disengagement of user support 14 from dock 20 when user support 14 is tilted upwardly at 70 to the noted upwardly tilted second position. FIG. 3 shows the locked position of the user support, i.e. with user support 14 in the noted first position, wherein the upper tip 84 of hook 50 is above the lower tip 86 of flange 80, and hence forward (rightward in FIG. 3) movement of user support 14 is blocked. Upon upward tilting of front end 60 of the user support, hook 50 moves downwardly and its upper tip 84 moves downwardly below lower tip 86 of flange 80 and is cleared for rightward movement therepast. This enables removal of user support 14 from dock 20. Hooks 50, 52 have a U-shape as shown at 88. Flanges 80, 82 are rearward of window openings 76, 78 and extend downwardly into U-shaped hooks 50, 52 at upwardly-opening U-shape 88 after wheels 38, 40 have been rolled through window openings 76, 78 and user support 14 has been tilted downwardly at front end 60 to the noted first position.

It is recognized that various equivalents, alternatives and modifications are possible within the scope of the appended claims.

What is claimed is:

1. An exercise station for an exercise device comprising a dock extending from said exercise device, and a user support engaging said dock in docking relation and releasably locked thereto, and comprising a pair of roller wheels on said user support for rolling said user support into engagement with said dock, wherein said user support is inserted in a rearward direction into engagement with said dock, and wherein said roller wheels are at a rear end of said user support, wherein said user support has a first position resting on a floor supporting said exercise device, and a second position tilted upwardly at its front end about its rear end, and wherein said wheels are mounted to said user support at said rear end such that said wheels engage said floor and are rollable therealong in said second position of said user support, and said wheels are spaced above and disengaged from said floor in said first position of said user support, wherein said dock has a pair of window openings receiving said roller wheels rolling rearwardly therethrough and locating said user support in nested relation at said dock.

2. An exercise station for an exercise device comprising a dock extending from said exercise device, and a user support engaging said dock in docking relation and releasably locked thereto, and comprising a pair of roller wheels on said user support for rolling said user support into engagement with said dock, wherein said user support is inserted in a rearward direction into engagement with said dock, and wherein said roller wheels are at a rear end of said user support, wherein said user support has a first position resting on a floor supporting said exercise device, and a second position tilted upwardly at its front end about its rear end, and wherein said wheels are mounted to said user support at said rear end such that said wheels engage said floor and are rollable therealong in said second position of said user support, and said wheels are spaced above and disengaged from said floor in said first position of said user support, wherein said user support has a hook at said rear end thereof, and said dock has a catch lying out of the path of movement of said hook when said user support is in said second position, to permit rearward movement of said user support rolling on said wheels and rearward movement of said hook past said catch, said catch lying in the path of movement of said hook when said user support is in said first position, to block forward movement of said user support by engagement of said hook against said catch, and permitting forward movement of said user support and disengagement of said user support from said dock when said user support is tilted to said second position.

3. An exercise station for an exercise device comprising a dock extending from said exercise device, and a user support engaging said dock in docking relation and releasably locked thereto, and comprising a pair of roller wheels on said user support for rolling said user support into engagement with said dock, wherein said user support is inserted in a rearward direction into engagement with said dock, and wherein said roller wheels are at a rear end of said user support, wherein said user support has a first position resting on a floor supporting said exercise device, and a second position tilted upwardly at its front end about its rear end, and wherein said wheels are mounted to said user support at said rear end such that said wheels engage said floor and are rollable therealong in said second position of said user support, and said wheels are spaced above and disengaged from said floor in said first position of said user support, wherein said roller wheels are mounted in journaled relation on a respective pair of hooks at said rear end of said user support, and said dock has a pair of catches lying out of the path of movement of said pair of hooks when said user support is in said second position, to permit rearward movement of said user support rolling on said wheels and rearward movement of said pair of hooks past said pair of catches, said pair of catches lying in the path of movement of said pair of hooks when said user support is in said first position, to block forward movement of said user support by engagement of said pair of hooks against said pair of catches, and permitting forward movement of said user support and disengagement of said user support from said dock when said user support is tilted to said second position.

4. The exercise station according to claim 3 wherein said hooks have a U-shape, and wherein said dock has a pair of window openings receiving said roller wheels rolling rearwardly therethrough and locating said user support in nested relation at said dock, and wherein said pair of catches comprise a pair of flanges rearward of said window openings and extending downwardly into respective said U-shaped hooks after said wheels have been rolled through said window openings and said user support is tilted downwardly to said first position.

5. An exercise station for an exercise device comprising a dock extending from said exercise device, and a user support engaging said dock in docking relation and releasably locked thereto wherein said dock comprises a foot plate resting on a floor supporting said exercise device, said foot plate having a front entrance end and a rear stop end, and a pair of sidewalls extending upwardly from said foot plate on distally opposite lateral sides thereof and tapered towards each other to a smaller lateral gap therebetween at said rear stop end than at said front entrance end to guide said user support inserted rearwardly along said foot plate from said front entrance end and guiding said user support to said rear stop end in nested relation thereat.

6. An exercise station for an exercise device comprising a dock extending from said exercise device, a user support engaging said dock in docking relation and releasably locked thereto, said dock comprising a foot plate resting a floor supporting said exercise device, said foot plate having a front entrance end and a rear stop end, and a pair of sidewalls extending upwardly from said foot plate on distally opposite lateral sides thereof and tapered towards each other to a smaller lateral gap therebetween at said rear stop end than at said front entrance end to guide said user support inserted rearwardly along said foot plate from said front entrance end and guiding said user support to said rear stop end in nested relation thereat, a pair of roller wheels on said user support for rolling said user support along said foot plate into engagement with said dock, said roller wheels being at the rear end of said user support, said user support having a first position resting on said floor, and a second position tilted upwardly at its front end about its rear end, said wheels being mounted to said user support at said rear end such that said wheels engage said floor and are rollable therealong and along said foot plate in said second position of said user support, said wheels being spaced above and disengaged from said floor in said first position of said user support, said dock having a pair of window openings at said rear stop end receiving said roller wheels rolling rearwardly therethrough and locating said user support in nested relation.

7. The exercise station according to claim 6 wherein said roller wheels are mounted in journaled relation on a respective pair of hooks at said rear end of said user support, and said dock has a pair of catches lying out of the path of movement of said pair of hooks when said user support is in said second position, to permit rearward movement of said user support rolling on said wheels and rearward movement of said pair of hooks past said pair of catches, said pair of catches lying in the path of movement of said pair of hooks when said user support is in said first position, to block forward movement of said user support by engagement of said pair of hooks against said pair of catches, and permitting forward movement of said user support and disengagement of said user support from said dock when said user support is tilted to said second position, said hooks having a U-shape, said catches comprising a pair of flanges rearward of said window openings and extending downwardly into respective said U-shaped hooks after said wheels have been rolled through said window openings and said user support is tilted downwardly to said first position.

8. A method for changing a user support at an exercise station for an exercise device, comprising providing a dock extending from said exercise device, and engaging said user support with said dock in docking relation and releasably locked thereto, and comprising providing a pair of roller wheels on said user support and rolling said user support into and out of engagement with said dock, and comprising inserting said user support in a rearward direction into engagement with said dock, and providing said roller wheels at a rear end of said user support, and comprising providing said user support with a first position resting on a floor supporting said exercise device, and a second position tilted upwardly at its front end about its rear end, providing said wheels mounted to said user support at said rear end such that said wheels engage said floor and are rollable therealong in said second position of said user support, and said wheels are spaced above and disengaged from said floor in said first position of said user support, and comprising raising said front end of said user support to said second position and rolling said user support into engagement with said dock, and lowering said front end of said user support to said second position to permit exercise, and changing said exercise station by lifting said front end of said user support to said second position and rolling said user support out of engagement with said dock, comprising providing said dock with a pair of window openings, and rolling said user support into engagement with said dock such that said roller wheels roll rearwardly through said window openings to locate said user support in nested relation at said dock.

9. A method for changing a user support at an exercise station for an exercise device, comprising providing a dock extending from said exercise device, and engaging said user support with said dock in docking relation and releasably locked thereto, and comprising providing a pair of roller wheels on said user support and rolling said user support into and out of engagement with said dock, and comprising inserting said user support in a rearward direction into engagement with said dock, and providing said roller wheels at a rear end of said user support, and comprising providing said user support with a first position resting on a floor supporting said exercise device, and a second position tilted upwardly at its front end about its rear end, providing said wheels mounted to said user support at said rear end such that said wheels engage said floor and are rollable therealong in said second position of said user support, and said wheels are spaced above and disengaged from said floor in said first position of said user support, and comprising raising said front end of said user support to said second position and rolling said user support into engagement with said dock, and lowering said front end of said user support to said second position to permit exercise, and changing said exercise station by lifting said front end of said user support to said second position and rolling said user support out of engagement with said dock, and comprising providing a hook at the rear end of said user support, providing a catch on said dock lying out of the path of movement of said hook when said user support is in said second position, and rolling said user support on said wheels in said second position rearwardly such that said hook moves rearwardly past said catch, said catch lying in the path of movement of said hook when said user support is in said first position, and comprising lowering said front end of said user support to said first position to block forward movement of said user support by engagement of said hook against said catch, and comprising raising said front end of said user support to said second position to permit forward movement of said user support rolling on said wheels and disengagement of said user support from said dock by clearance of said hook forwardly past said catch in said second position of said user support rolling on said wheels.

10. The method according to claim 9 comprising journaling said roller wheels on a pair of said hooks.

11. The method according to claim 9 comprising providing said hook with a U-shape, and providing said catch by a flange extending downwardly into said U-shaped hook after said user support has been tilted downwardly to said first position.

* * * * *